US010503118B2

(12) United States Patent
Komatsuzaki et al.

(10) Patent No.: US 10,503,118 B2
(45) **Date of Patent: *Dec. 10, 2019**

(54) IMAGE FORMING APPARATUS HAVING AIR COOLING SYSTEM

(71) Applicants: Tomohiro Komatsuzaki, Kanagawa (JP); Osamu Kitagawa, Kanagawa (JP)

(72) Inventors: Tomohiro Komatsuzaki, Kanagawa (JP); Osamu Kitagawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/180,239

(22) Filed: Nov. 5, 2018

(65) Prior Publication Data

US 2019/0086862 A1 Mar. 21, 2019

Related U.S. Application Data

(63) Continuation of application No. 15/637,177, filed on Jun. 29, 2017, now Pat. No. 10,162,305, which is a (Continued)

(30) Foreign Application Priority Data

Apr. 28, 2015 (JP) ..... 2015-091979

(51) Int. Cl.
*G03G 21/20* (2006.01)
*G03G 15/00* (2006.01)

(Continued)

(52) U.S. Cl.
CPC ..... *G03G 21/206* (2013.01); *B65H 1/00* (2013.01); *B65H 29/14* (2013.01); *B65H 29/52* (2013.01);

(Continued)

(58) Field of Classification Search
CPC ..... G03G 21/206; G03G 2221/1645
See application file for complete search history.

(56) References Cited

U.S. PATENT DOCUMENTS 9,727,022 B2 * 8/2017 Komatsuzaki ..... G03G 21/206
10,162,305 B2 * 12/2018 Komatsuzaki ..... G03G 21/206

(Continued)

FOREIGN PATENT DOCUMENTS

CN 1971449 A 5/2007
CN 102063035 A 5/2011

(Continued)

OTHER PUBLICATIONS

Office Action for Corresponding Chinese Patent Application No. 201610277773.3 dated Feb. 28, 2018.

(Continued)

*Primary Examiner* — Sandra Brase
(74) *Attorney, Agent, or Firm* — Harness, Dickey & Pierce, P.L.C.

(57) ABSTRACT

An image forming apparatus includes an apparatus body, an image forming device to form an image on a recording medium, a casing to accommodate the image forming device, a sheet discharging port through which the recording medium having the image is discharged from the casing, a sheet stacker to stack the recording medium output through the sheet discharging port and opening on one side of the apparatus body and surrounded by outer walls including an outer wall having the sheet discharging port, an air guide opening disposed within a sheet passing range in a width direction of the recording medium in a sheet conveying path through which the recording medium having the image passes from the image forming device to the sheet discharging port, and an air suction fan to discharge air passing through the air guide opening to an outside of the casing.

7 Claims, 8 Drawing Sheets

Related U.S. Application Data continuation of application No. 15/132,371, filed on Apr. 19, 2016, now Pat. No. 9,727,022.

(51) Int. Cl.

| | |
|---|---|
| ***B65H 1/00*** | (2006.01) |
| ***B65H 29/52*** | (2006.01) |
| ***B65H 29/14*** | (2006.01) |
| ***B65H 31/02*** | (2006.01) |

(52) U.S. Cl.

CPC ..... *B65H 31/02* (2013.01); *G03G 15/6552* (2013.01); *B65H 2301/5144* (2013.01); *B65H 2301/5305* (2013.01); *B65H 2404/6111* (2013.01)

(56) References Cited

U.S. PATENT DOCUMENTS

| | | | | |
|---|---|---|---|---|
| 2005/0074255 | A1 | 4/2005 | Awaya | |
| 2005/0232653 | A1 | 10/2005 | Murooka | |
| 2007/0110469 | A1 | 5/2007 | Kasai | |
| 2007/0121142 | A1 | 5/2007 | Kasai et al. | |
| 2008/0038008 | A1 | 2/2008 | Fujita et al. | |
| 2008/0044213 | A1 | 2/2008 | Kato et al. | |
| 2011/0116827 | A1 | 5/2011 | Akagawa | |
| 2011/0229166 | A1 | 9/2011 | Mori et al. | |
| 2012/0070215 | A1 | 3/2012 | Murakami et al. | |
| 2012/0201564 | A1 | 8/2012 | Masuda | |
| 2013/0236228 | A1* | 9/2013 | Nagasako | G03G 15/6552 399/405 |
| 2014/0029999 | A1 | 1/2014 | Masuta | |
| 2014/0161481 | A1 | 6/2014 | Udagawa | |
| 2014/0376949 | A1 | 12/2014 | Fujita et al. | |

FOREIGN PATENT DOCUMENTS

| | | | |
|---|---|---|---|
| CN | 102193364 | A | 9/2011 |
| JP | H05-113708 | A | 5/1993 |
| JP | H09-166954 | A | 6/1997 |
| JP | 2000-259064 | A | 9/2000 |
| JP | 2003-307996 | A | 10/2003 |
| JP | 2007-147834 | A | 6/2007 |
| JP | 2007-156418 | A | 6/2007 |
| JP | 2007-232949 | A | 9/2007 |
| JP | 2012-073587 | A | 4/2012 |

OTHER PUBLICATIONS

Office Action for Corresponding Japanese Patent Application No. 2017-172073 dated May 18, 2018.

Office Action for Corresponding Chinese Patent Application No. 201710804270.1 dated Oct. 17, 2018.

Office Action for Corresponding Japanese Patent Application No. 2015-091979 dated Jan. 25, 2019.

* cited by examiner

Related Art

IMAGE FORMING APPARATUS HAVING AIR COOLING SYSTEM

CROSS-REFERENCE TO RELATED APPLICATIONS

This application is a continuation application of and claims priority under 35 U.S.C. § 120/121 to U.S. application Ser. No. 15/637,177 filed Jun. 29, 2017, which is a continuation application of and claims priority under 35 U.S.C. § 120/121 to U.S. application Ser. No. 15/132,371 filed Apr. 19, 2016, which claims priority under 35 U.S.C. § 119(a) to Japanese Patent Application No. 2015-091979, filed on Apr. 28, 2015, in the Japan Patent Office, the entire contents of each of which are hereby incorporated by reference herein.

BACKGROUND

Technical Field

This disclosure relates to an image forming apparatus.

Related Art

A known electrophotographic image forming apparatus has a configuration in which an image forming device that is disposed in a housing forms an image on a recording medium and the recording medium is discharged through a sheet discharging port to a sheet discharging part that is disposed outside the housing. Such a known electrophotographic image forming apparatus employs an in-body output sheet stacking section arranged inside an apparatus body, which corresponds to the sheet discharging part.

For example, a known electrographic image forming apparatus that includes such an in-body output sheet stacking section includes an air drawing device on one side wall that is disposed outside a sheet width direction of a recording medium traveling in a sheet conveying path extending between a fixing unit and a sheet discharging port. The air drawing device draws air flowing in the sheet conveying path and discharges the air to an outside of the image forming apparatus.

SUMMARY

At least one aspect of this disclosure provides an image forming apparatus including an apparatus body, an image forming device, a casing, a sheet discharging port, a sheet stacker, an air guide opening, and an air suction fan. The image forming device is disposed in the apparatus body to form an image on a recording medium. The casing is provided to accommodate the image forming device. The sheet discharging port is an opening through which the recording medium having the image formed by the image forming device is discharged from the casing. The sheet stacker stacks the recording medium output through the sheet discharging port. The sheet stacker is surrounded by outer walls and opens on one side of the apparatus body. The outer walls includes an outer wall having the sheet discharging port. The air guide opening is disposed within a sheet passing range in a width direction of the recording medium in a sheet conveying path through which the recording medium having the image passes from the image forming device to the sheet discharging port. The air suction fan is disposed in the apparatus body to discharge air passing through the air guide opening to an outside of the casing.

Further, at least one aspect of this disclosure provides an image forming apparatus including a fixing device to fix an image formed on a recording medium to the recording medium, a sheet discharging rotary body to discharge the recording medium that has passed through the fixing device, a guide disposed between the fixing device and the sheet discharging rotary body to guide the recording medium to the sheet discharging rotary body and including multiple air guide openings within a range facing the recording medium, and an air suction fan disposed above the multiple air guide openings and discharging air drawn via the multiple air guide openings to an outside of an apparatus body.

DETAILED DESCRIPTION

Figure 1:
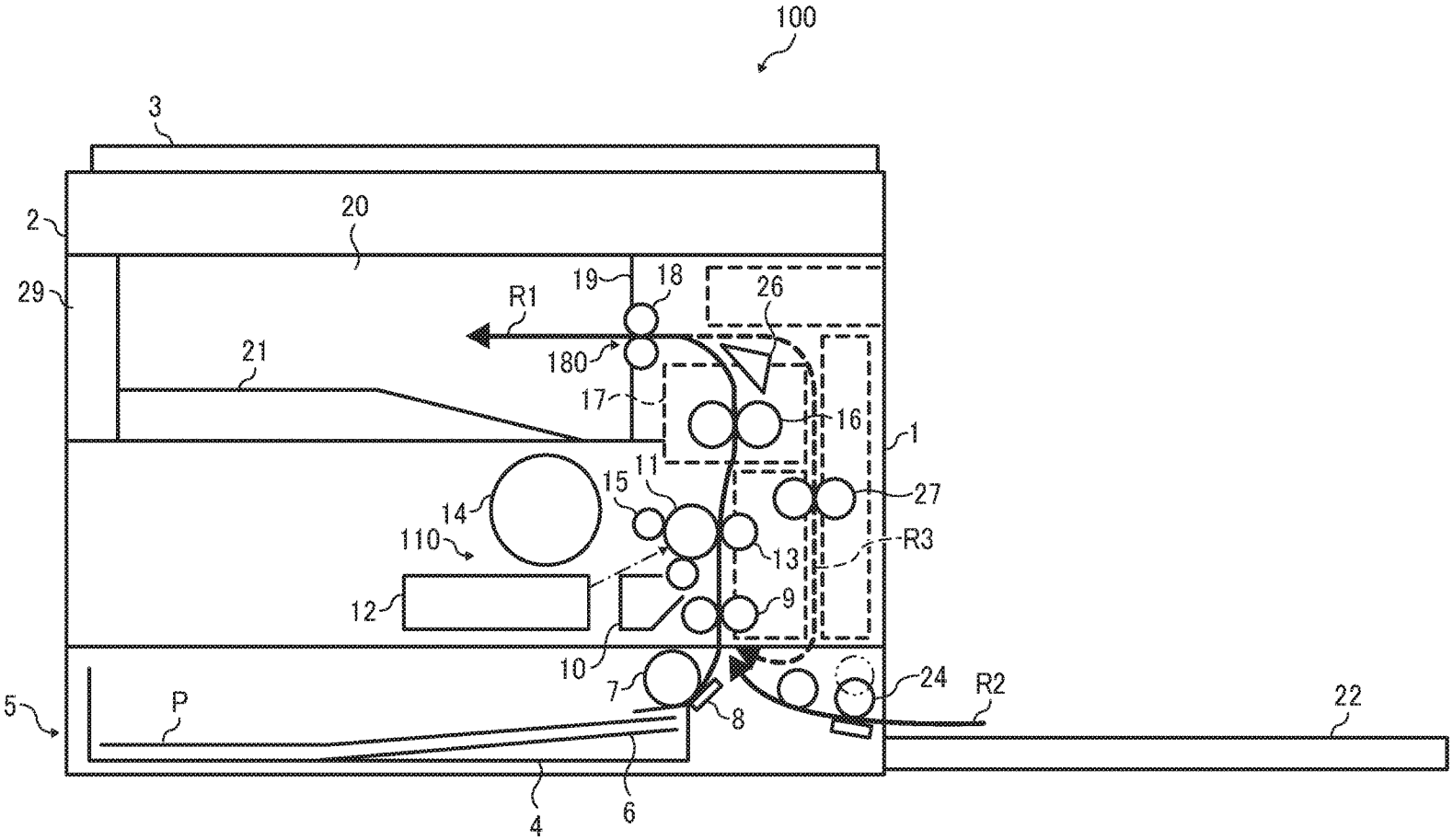
FIG. 1 is a schematic view illustrating an entire configuration of the image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Now, a description is given of an electrophotographic image forming apparatus 100 for forming images by electrophotography. It is to be noted that, hereinafter, the electrophotographic image forming apparatus 100 is referred to as the image forming apparatus 100. In the present embodiment, the image forming apparatus 100 is a monochrome image forming apparatus. However, the configuration is not limited thereto. For example, this disclosure can be also applied to a known image forming apparatus. It is also to be noted that, while the image forming apparatus 100 according to the present embodiment is a compact and desktop-type image forming apparatus, a relatively large image forming apparatus that is installed on the floor can also be applied to this disclosure.

A description is given of a configuration of the image forming apparatus 100 according to an embodiment of this disclosure, with reference to FIG. 1.

It is to be noted that identical parts are given identical reference numerals and redundant descriptions are summarized or omitted accordingly.

The image forming apparatus 100 may be a copier, a facsimile machine, a printer, a multifunction peripheral or a multifunction printer (MFP) having at least one of copying, printing, scanning, facsimile, and plotter functions, or the like. According to the present example, the image forming apparatus 100 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

FIG. 1 is a schematic view illustrating an entire configuration of the image forming apparatus 100 according to an embodiment of this disclosure.

The image forming apparatus 100 includes an apparatus body 1, a document reading device 2, and a document pressing plate 3. The apparatus body 1 is provided to perform image formation. The image forming apparatus 100 further includes a sheet feeder 5 that includes a sheet tray 4. The sheet feeder 5 is disposed below the apparatus body 1. The sheet tray 4 is detachably attachable to the image forming apparatus 100. That is, the sheet tray 4 can be removed from the image forming apparatus 100 of FIG. 1 toward a front side direction of FIG. 1.

The image forming apparatus 100 further includes a sheet conveying path indicated by arrow R1 in FIG. 1. A sheet P accommodated in the sheet tray 4 travels in the sheet conveying path R1. The sheet P that is accommodated and loaded in the sheet tray 4 has a leading edge, which is located to the right side in FIG. 1. A movable bottom plate 6 pushes up the leading edge of the sheet P. Then, a sheet feed roller 7 in rotation applies a sheet conveying force in an upper right direction of FIG. 1. A friction pad 8 separates the sheet P one by one from the other sheets P in the sheet tray 4. The separated sheet P is conveyed to a pair of registration rollers 9 that includes two rollers disposed facing each other. The pair of registration rollers 9 in rotation adjusts a timing of movement of the sheet P while the sheet P is vertically conveyed up toward a transfer position where a toner image is transferred onto the sheet P.

While a drum-shaped photoconductor 11 is rotating, a charging roller 15 uniformly charges a surface of the photoconductor 11. An optical writing unit 12 emits laser light to irradiate the surface of the photoconductor 11, so that an electrostatic latent image is formed on the surface of the photoconductor 11.

The electrostatic latent image is developed by a developing device 10 into a visible toner image. As the photoconductor 11 rotates, the toner image reaches the transfer position where the photoconductor 11 and a transfer roller 13 are disposed facing each other. Then, when the sheet P passes the transfer position, the toner image is formed on one side of the sheet P, which is the left side of FIG. 1. The developing device 10 consumes toner contained therein by development of the toner image. Therefore, a toner bottle 14 is disposed above the optical writing unit 12 in FIG. 1, so that the toner is supplied to the developing device 10.

The sheet P having the visible toner image is conveyed to a fixing unit 17 that is disposed above the transfer position. The fixing unit 17 includes a pair of thermal fixing rollers 16 and a heater. The pair of thermal fixing rollers 16 that is heated by the heater applies heat and pressure to the sheet P, thereby fixing the toner image to the sheet P. The image forming apparatus 100 further includes a pair of sheet discharging rollers 18 that includes two rollers. The pair of sheet discharging rollers 18 discharges the sheet P that has passed through the fixing unit 17 to the outside of a casing 19 via a sheet discharging port 180. The casing 19 is a housing that contains an image forming device 110 that performs image formation. The image forming device 110 includes a sheet charging roller 15, the photoconductor 11, the optical writing unit 12, the developing device 10, the transfer roller 13, and the fixing unit 17. An output sheet stacker 20 is disposed in an in-body sheet discharging space of the image forming apparatus 100. Specifically, the output sheet stacker 20 includes a space that is located below the document reading device 2 and outside of the sheet discharging port 180 through which the sheet P is discharged from the casing 19. The output sheet stacker 20 is surrounded and defined by walls. One wall out of the walls surrounding the output sheet stacker 20 includes the sheet discharging port 180. The output sheet stacker 20 that is an in-body output sheet stacking section opens on one side surface of the apparatus body 1 of the image forming apparatus 100. In other words, the output sheet stacker 20 is defined by the walls of the apparatus body 1 and the document reading device 2. After passing through the sheet discharging port 180, the sheet P is discharged to the output sheet stacker 20. The sheet P discharged in the output sheet stacker 20 is placed on an output tray 21 with the image side facing down. The output tray 21 that receives discharged sheets P functions as a lower face of the output sheet stacker 20.

The image forming apparatus 100 further includes a different sheet feeding section besides the sheet tray 4. The different sheet feeding section is a bypass feeder that includes a bypass tray 22. The bypass feeder feeds a sheet P placed on the bypass tray 22 that is rotatable to the right direction to open in FIG. 1. The image forming apparatus 100 further includes a sheet conveying path indicated by arrow R2 in FIG. 1.

The sheet P placed in the bypass tray 22 travels in the sheet conveying path R2. As a sheet feed roller 24 rotates vertically, the sheet P placed in the bypass tray 22 is fed to the left side in FIG. 1 to be guided by the pair of registration rollers 9. Then, the sheet P meets the sheet conveying path R1. Thereafter, the sheet P is conveyed in the same manner when the sheet P that is accommodated in the sheet tray 4.

As described above, the single-side printing is performed in the image forming apparatus 100.

Next, a description is given of a route and operations of the sheet P in duplex printing in the image forming apparatus 100.

The image forming apparatus 100 further includes a sheet reverse path indicated by a broken arrow R3 in FIG. 1. A sheet P for duplex printing travels in the sheet reverse path R3 after an image is formed on one side of the sheet P.

Similar to the single-side printing described above, the sheet P having an image on one side is output to expose half on the leading edge side while being held between the rollers of the pair of sheet discharging rollers 18. Then, the sheet P is stopped at a point where the trailing edge of the sheet P has passed the leading edge of a reverse path switching claw 26. In this case, when the trailing edge of the sheet P passes the leading edge of the reverse path switching claw 26, the sheet P moves to a higher position than the leading edge of the reverse path switching claw 26 due to stiffness of the sheet P. Here, when the pair of sheet discharging rollers 18 is reversely rotated, the sheet P passes over the reverse path switching claw 26 in the sheet reverse path R3 as indicated by a broken arrow in FIG. 1. Then, the sheet P is guided downwardly by a guide provided in the sheet reverse path R3 to be conveyed further downwardly.

After passing between the pair of duplex conveyance rollers 27, the sheet P is guided by the guide disposed in the sheet reverse path R3 to be conveyed and turned as indicated by a broken arrow in FIG. 1. Then, the sheet P is guided to the pair of registration rollers 9 again. Thus, an image is formed on the other side of the sheet P for duplex printing. The sheet P having images on both sides is discharged onto the output tray 21.

A support pillar 29 that is a cylindrical member disposed on the left side of the output sheet stacker 20 in FIG. 1 is disposed on the front on the left side of FIG. 1 and functions as a support to support the document reading device 2. The printed sheet P that is output to the output tray 21 is taken out constantly from the front that is a near side in FIG. 1. In a case in which the sheet P cannot be removed from the front, the sheet P is taken out from the left side.

In the image forming apparatus 100 illustrated in FIG. 1, when the image is fixed by application of heat and pressure in the fixing unit 17, the ambient temperature of the fixing unit 17 is heated while the sheet P is heated for fixing, and therefore the temperature of air around the fixing unit 17 is increased. Further, the image forming apparatus 100 illustrated in FIG. 1 includes the output tray 21 in an in-body output sheet stacking section of the apparatus body 1. Therefore, an installation space of the electrophotographic image forming apparatus 100 can be reduced. In such the image forming apparatus (e.g., the image forming apparatus 100), the sheet (e.g., the sheet P) having an image on one side or two images on both sides passes the fixing unit (e.g., the fixing unit 17) to be discharged to the sheet discharging tray (e.g., the output tray 21). Consequently, air heated in the fixing unit is discharged to the in-body output sheet stacking section with the sheet. As a result, the temperature of air in the in-body output sheet stacking section increases, and therefore it is likely to increase the temperatures of components and parts defining the in-body output sheet stacking section of the image forming apparatus.

Figure 2:
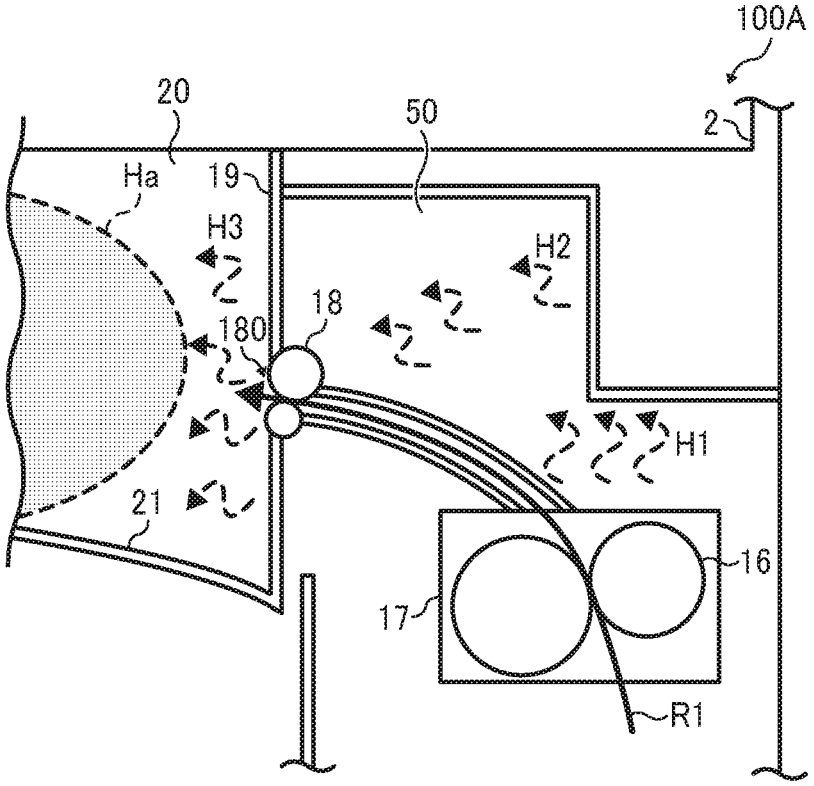
FIG. 2 is a schematic enlarged view illustrating an area near a fixing unit and a sheet discharging port of a comparative image forming apparatus that discharges sheets to an in-body output sheet stacker.

FIG. 2 is a schematic enlarged view illustrating the flow of air whose temperature increases in an area near the fixing unit 17 and the sheet discharging port 180 of a comparative image forming apparatus 100A that discharges sheets to the sheet discharging port 180.

Reference signals "H1", "H2", and "H3" indicated by broken arrows in FIG. 2 indicate respective air flows of air heated in the fixing unit 17.

Air near the fixing unit 17 is heated together with the sheet P when an image is fixed by application of heat and pressure, and the temperature of the air increases, as indicated by the air flow H1 in FIG. 2. Then, the heated air that has reached a discharging port interior space 50 disposed in the vicinity of the highest part of the casing 19 flows toward the sheet discharging port 180 through which the air flows towards the outside of the casing 19, as indicated by the air flow H2 in FIG. 2. Then, the heated air is discharged together with the sheet P from the sheet discharging port 180 to the output sheet stacker 20, as indicated by the air flow H3 in FIG. 2.

In an apparatus such as the comparative image forming apparatus 100A in which the sheet P having an image thereon is discharged in the in-body output sheet stacker 20, when the heated air is discharged outside together with the sheet P, the heated air stays in the space of the output sheet stacker 20, as indicated by an area Ha in FIG. 2. As a result, the temperature of the air in the output sheet stacker 20 increases. Consequently, the heat of the high-temperature air gradually spreads around, causing an increase in the temperature of the comparative image forming apparatus 100A.

However, as the temperature inside the image forming apparatus 100 increases, the temperature of the document reading device 2 also increases. Consequently, the optical components in the document reading device 2 may be deformed or distorted. If a document is read by the distorted components, it is likely that the image quality deteriorates. Further, as the temperature in the apparatus body 1 increases, the toner can melt and harden inside the apparatus body 1, resulting in generation of fixed toner and coagulated toner, and therefore it is likely to degrade the image quality. Further, if the air in the output sheet stacker 20 is heated, it is likely that a user feels uncomfortable by contacting the heated air when removing the sheet P having the image or images from the output sheet stacker 20.

For example, a known electrographic image forming apparatus includes an air drawing device. The air drawing device is disposed on a rear plate (i.e., a far side wall in FIG. 2) of the comparative image forming apparatus 100A. The rear plate is located outside in the width direction of the sheet conveying path between the fixing unit 17 and the sheet discharging port 180. The air drawing device intakes outside air through an opening on a front plate (i.e., a near side wall in FIG. 2) of the comparative image forming apparatus 100A. The outside air passes through the space near the sheet conveying path between the fixing unit 17 and the sheet discharging port 180, and goes out from the rear plate on which the air drawing device is disposed.

In this configuration, since the heated air on the front side of the comparative image forming apparatus 100A flows toward the rear side, the temperature of the rear side of the comparative image forming apparatus 100A increases. Then, as the heated air moves to the rear side of the comparative image forming apparatus 100A, the air around the rear side is heated. Consequently, the temperature of an upstream side of the sheet conveying path and the temperature of a downstream side of the sheet conveying path become different from each other. In order to reduce the temperature of air over the entire width direction of the air drawing device sufficiently, the air drawing device is set to have high specifications, thereby decreasing the efficiency to prevent an increase in temperature of the air drawing device. Further, this configuration extremely reduces the temperature of air on the front side of the air drawing device where the temperature is lowest. Since the heat generated in the fixing unit 17 is conducted to the cooled air, it is likely to cool an area in the vicinity of the fixing unit 17 extremely. If the area near the fixing unit 17 is extremely cooled, the heater of the fixing unit 17 is turned on more quickly, and therefore the power consumption of the apparatus body 1 of the comparative image forming apparatus 100A increases. Therefore, it is demanded to discharge air in the discharging port interior space 50 more efficiently.

Another comparative image forming apparatus has a configuration in which air in the in-body output sheet stacking section is drawn to be exhausted from the rear side of the image forming apparatus. Thus, in the configuration in which air in the in-body output sheet stacking section is drawn, the heated air can be discharged outside the in-body output sheet stacking section. Therefore, this configuration can prevent the heated air from staying in the in-body output sheet stacking section. However, the heated air continuously flows from the sheet discharging port to the in-body output sheet stacking section with the sheet. In this case, the heated air is supplied constantly to the in-body output sheet stacking section, and therefore an increase in temperature of the air in the in-body output sheet stacking section cannot be prevented.

In addition, the comparative image forming apparatus further includes an air exhaust path through which heat from the fixing unit, for example, is exhausted to the outside of the comparative image forming apparatus. However, air is drawn and exhausted from one end in the width direction of the image forming apparatus, and therefore temperature gradient occurs in the width direction of the image forming apparatus. Specifically, the temperature in the image forming apparatus gradually increases from one end of the air exhaust path on which the air drawing device is not disposed toward the other end on which the air drawing device is disposed in the width direction of the image forming apparatus.

Next, a description is given of the detailed configuration of the image forming apparatus 100 according to the present embodiment of this disclosure.

Figure 3:
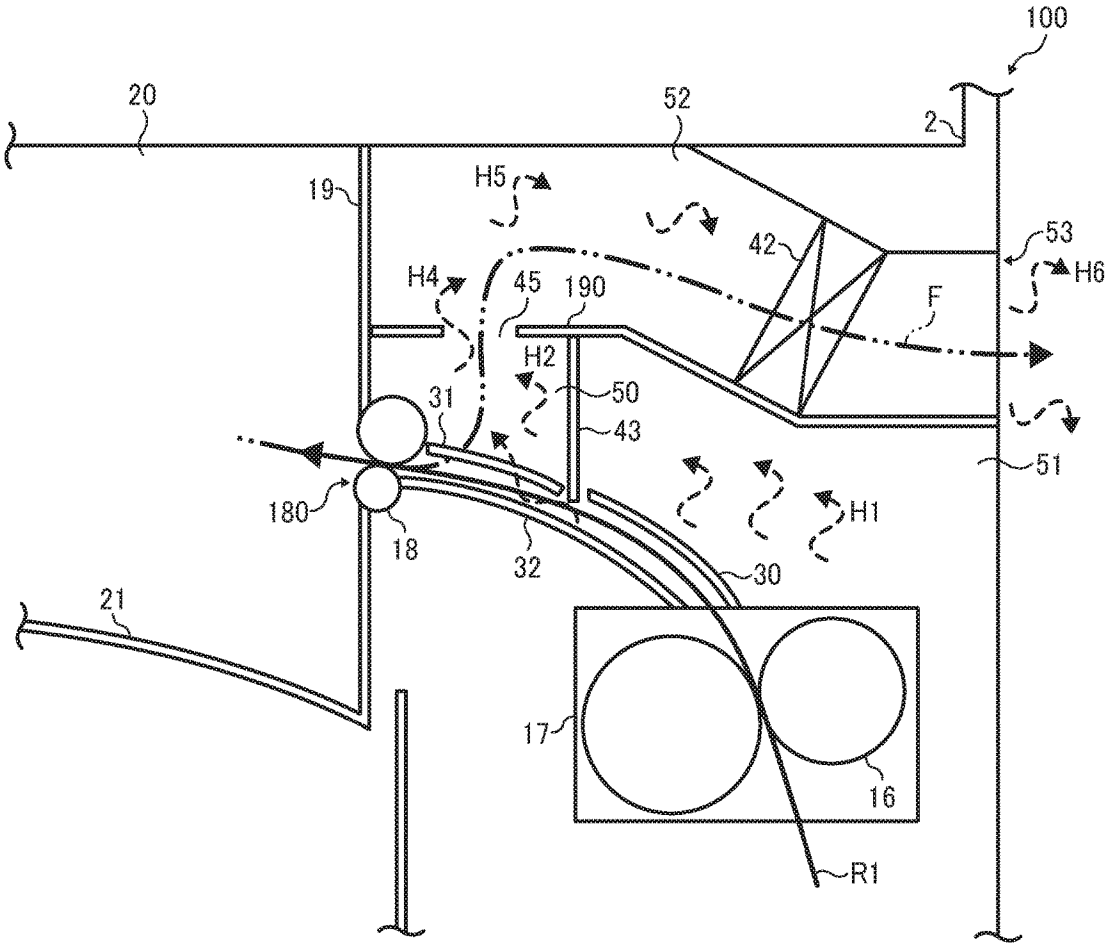
FIG. 3 is a schematic enlarged view illustrating an area near a fixing unit and a sheet discharging port of an image forming apparatus according to an embodiment of this disclosure.
Figure 4:
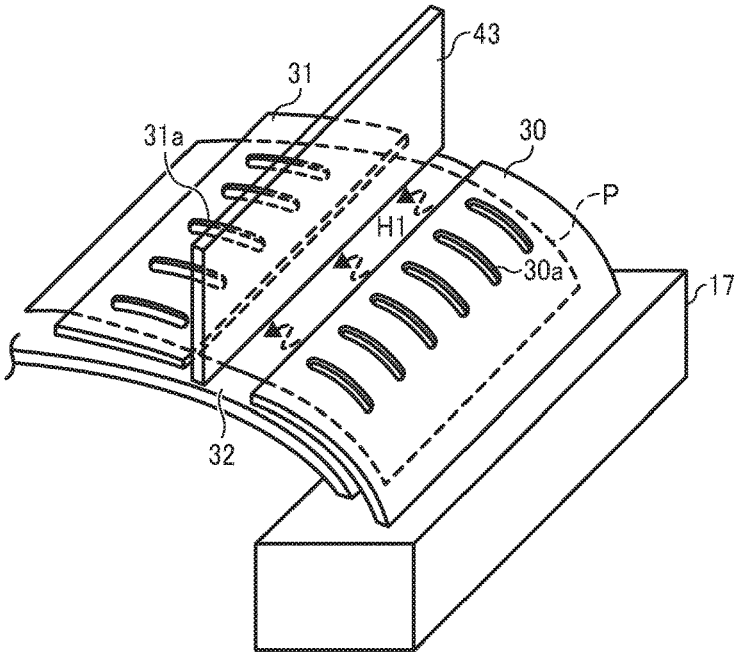
FIG. 4 is an enlarged perspective view illustrating an area near a sheet conveying path extending between the fixing unit and the sheet discharging port.

FIG. 3 is a schematic enlarged view illustrating an area near the fixing unit 17 and the sheet discharging port 180 of the image forming apparatus 100 according to the present embodiment of this disclosure. FIG. 4 is an enlarged perspective view illustrating an area near the sheet conveying path R1 between the fixing unit 17 and the sheet discharging port 180.

As illustrated in FIGS. 3 and 4, the sheet conveying path R1 between the fixing unit 17 and the sheet discharging port 180 is defined by an upstream upper guide plate 30, a downstream upper guide plate 31, and a lower guide plate 32. The upstream upper guide plate 30 is disposed upstream from the sheet discharging port 180 in the sheet conveying path R1 and above the sheet conveying path R1. The downstream upper guide plate 31 is disposed upstream from the sheet discharging port 180 and downstream from the upstream upper guide plate 30 in the sheet conveying path R1 and above the sheet conveying path R1. The lower guide plate 32 is disposed upstream from the sheet discharging port 180 in the sheet conveying path R1 and below the sheet conveying path R1. As illustrated in FIG. 4, the upstream upper guide plate 30 includes an upstream side guide opening 30*a* and the downstream upper guide plate 31 includes a downstream side guide opening 31*a*. The upstream side guide opening 30*a* and the downstream side guide opening 31*a* are disposed within a sheet passing range in the width direction of the sheet P in the sheet conveying path R1 (i.e., a direction from the front side to the rear side of the image forming apparatus 100 illustrated in FIG. 3.

Each of the upstream side guide opening 30*a* and the downstream side guide opening 31*a* has a shape of a slot extending in the sheet conveying direction of the sheet P.

Further, when a direction intersecting the sheet conveying direction of the sheet P is defined as a width direction of the sheet P, the upstream side guide opening 30*a* and the downstream side guide opening 31*a* are disposed within a sheet passing range in the width direction of the sheet P. Therefore, both lateral ends in the width direction of the sheet P do not enter into the upstream side guide opening 30*a* and the downstream side guide opening 31*a* and can be prevented from being caught by the upstream side guide opening 30*a* and the downstream side guide opening 31*a*.

Further, the image forming apparatus 100 further includes at least one air drawing opening such as the downstream side guide opening 31*a* in the width direction of the sheet P. By including multiple air drawing openings, the temperature gradient in the width direction of the sheet P in the sheet conveying path R1 can be prevented. Further, even when a single air drawing opening is provided, if the single air drawing opening is a long slot extending in the width direction of the sheet P, the same effect as above can be provided.

As illustrated in FIG. 3, the image forming apparatus 100 includes a wall 190 that functions as a duct lower plate to block a space above the fixing unit 17. The wall 190 also functions as a partition that separates the fixing unit 17 and the pair of sheet discharging rollers 18 from an air flow indicated by a broken arrow F in FIG. 3. The wall 190 forms a lower face of an air exhaust duct 52. The wall 190 that functions as a duct lower plate includes an air passage opening 45 disposed facing the downstream upper guide plate 31. An air suction fan 42 that functions as an air suction fan and an air suction device is disposed inside the air exhaust duct 52. The air passage opening 45 is disposed above an area where the sheet P passes in the width direction of the sheet P in the sheet conveying path R1 (i.e., the front to rear direction in FIG. 3). Further, the air passage opening 45 is disposed facing the downstream side guide opening 31*a*.

By driving the air suction fan 42, an air flow H5 in the air exhaust duct 52 is drawn to the air suction fan 42 to move to the right in FIG. 3 and discharged from the air exhaust port 53 to the outside of the image forming apparatus 100 (indicated as an air flow H6).

Further, by driving the air suction fan 42, a negative pressure is applied on the air passage opening 45. Consequently, the air flow H2 of the air flowing inside the discharging port interior space 50 passes through the air passage opening 45 to move toward the air exhaust duct 52 (indicated as an air flow H4). With this movement of air, a negative pressure is also applied on the downstream side guide opening 31*a*. Consequently, the air inside the sheet conveying path R1 passes through the downstream side guide opening 31*a* to move toward the discharging port interior space 50. Further, with this movement of air, a negative pressure is also applied on the sheet discharging port 180. Consequently, the air inside the output sheet stacker 20 passes through the sheet discharging port 180 to move toward the sheet conveying path R1 of the sheet P.

By driving the air suction fan 42, the above-described movements of air occur. Therefore, the air flow indicated by a broken arrow F in FIG. 3 is generated, flowing toward the outside of the image forming apparatus 100 from the output sheet stacker 20 via the sheet conveying path, the discharging port interior space 50, and the air exhaust duct 52.

As illustrated in FIGS. 3 and 4, the image forming apparatus 100 draws air via the downstream side guide opening 31*a* and the air passage opening 45, both of which are disposed inside an area where the sheet P passes in the sheet conveying path in the width direction of the sheet P. With this configuration, an area around the downstream side guide opening 31*a* in the sheet conveying path in the width direction of the sheet P reaches a highest temperature. Therefore, the image forming apparatus 100 has the temperature gradient in which the temperature changes from the area in the vicinity of the downstream side guide opening 31*a* and gradually decreases as the air moves far from the downstream side guide opening 31*a*. As described above, the downstream side guide opening 31*a* is disposed inside the area where the sheet P passes in the sheet conveying path in the width direction of the sheet P. Accordingly, the temperature of a far end side of the sheet conveying path in the width direction of the sheet P, which is far from the downstream side guide opening 31*a* is lower than a near end side of the sheet conveying path in the width direction of the sheet P. Specifically, the temperature of the far end side of the sheet conveying path in the width direction of the sheet P is lowest in the image forming apparatus 100. At this time, a distance between a portion at the highest temperature and a portion at the lowest temperature in the sheet conveying path in the sheet width direction of the image forming apparatus 100 is shorter than a distance thereof in a configuration in which air is drawn from one end side of the sheet conveying path in the width direction of the sheet P. Therefore, a difference of temperatures in the sheet width direction generated due to temperature gradient can be reduced.

Further, by arranging multiple downstream side guide openings 31*a* and multiple air passage openings 45 in the sheet width direction, the air can be drawn over the entire sheet width direction when compared with the configuration in which air is drawn from one end side of the sheet conveying path in the width direction of the sheet P. By so doing, the heated air inside the sheet conveying path R1 and the discharging port interior space 50 in the sheet width direction can be discharged thoroughly to the outside of the image forming apparatus 100, and therefore the temperature gradient in the sheet conveying path R1 in the sheet width direction can be reduced.

Further, the air flow H1 of the air heated by heat of the fixing unit 17 is drawn at a position upstream from the sheet discharging port 180 in the sheet conveying direction and is exhausted to the outside of the image forming apparatus 100. Therefore, the air flow H1 of the air at high temperature is prevented from being discharged to the output sheet stacker 20. Consequently, an increase in the temperature of the output sheet stacker 20 can be prevented.

In the image forming apparatus 100 according to the present embodiment of this disclosure, the air suction fan 42 is disposed above an area where the sheet P passes through in the width direction in the sheet conveying path (i.e., the front to rear direction in FIG. 3). The downstream side guide opening 31*a* is disposed above the sheet conveying path through which the sheet P is conveyed in the horizontal direction. According to this configuration, when the air suction fan 42 is driven, an air flow that moves in a direction perpendicular to the sheet conveying direction R1 and the sheet width direction is generated.

Accordingly, the image forming apparatus 100 includes the air suction fan 42 in the area where the sheet P passes in the sheet width direction of the sheet conveying path, so as to draw air in a direction perpendicular to in the sheet conveying direction. According to this configuration, air can be drawn over the entire sheet width direction, and therefore an air flow indicated by a two-dot chain line arrow F in FIG. 3 is generated to draw air over the entire sheet width direction of the sheet P efficiently.

By drawing air from the sheet conveying path R1 efficiently, the sheet discharging port 180 can generate an air flow moving from the output sheet stacker 20 to the sheet conveying path R1. More specifically, by drawing vapor such as air flowing as the air flow H2 and the air flow H4 from an air drawing opening such as the air passage opening 45, the air suction fan 42 can generate an air flow that moves from an output sheet stacking section such as the output sheet stacker 20 into an interior of an housing such as the casing 19 via a sheet exhaust port such as the sheet discharging port 180. According to the air flow, an air flow that moves in a direction opposite to the sheet conveying direction of the sheet P is generated in an area in the vicinity of the sheet discharging port 180. Therefore, the heated air is prevented from being discharged from the sheet discharging port 180 to the output sheet stacker 20 together with the sheet P. Consequently, an increase in the temperature of the output sheet stacker 20 can be prevented.

Further, the air suction fan 42 draws vapor such as air in the sheet conveying path R1 between the fixing unit 17 and a discharging port such as the sheet discharging port 180. Accordingly, the vapor such as the air is exhausted toward the outside of the image forming apparatus 100 before the air flow H1 of the air heated in the fixing unit 17 is discharged from the sheet discharging port 180. Therefore, the air flow H1 of the air at high temperature is prevented from being discharged to an output sheet stacker such as the output sheet stacker 20. Consequently, an increase in the temperature of the output sheet stacker 20 can be prevented.

Figure 5:
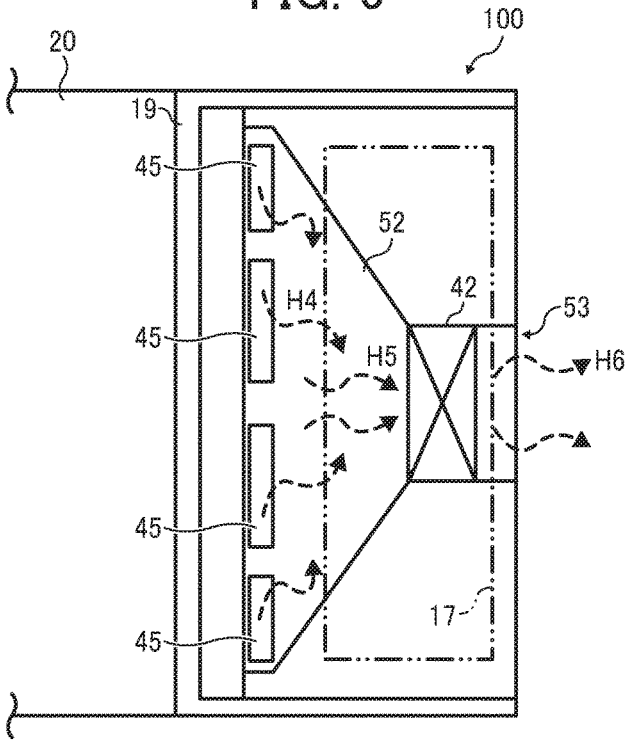
FIG. 5 is a schematic top view illustrating an air exhaust duct.

FIG. 5 is a schematic top view illustrating the air exhaust duct 52.

As illustrated in FIG. 5, the image forming apparatus 100 further includes multiple air passage openings 45. The image forming apparatus 100 draws air from each of the multiple air passage openings 45 and exhausts the air flow H4 from the air exhaust port 53 that is disposed on the right side face of the apparatus body 1 of the image forming apparatus 100 (indicated as the air flow H5 and the air flow H6). Each of the air passage openings 45 has a shape of a slot extending in the sheet width direction that intersects the sheet conveying direction of the sheet P and is disposed facing (or right above) the downstream side guide opening 31*a*. Further, in order to increase the exhaust efficiency, the air exhaust duct 52 that defines an air flow path has a shape that tapers from the air passage opening 45 to the air suction fan 42. In a case in which the air suction fan 42 has high specifications or in which the multiple air suction fans 42 are arranged in parallel, the air exhaust duct 52 may not have the tapered shape. By disposing the multiple air drawing devices, a flow path in which vapor such as air moves from an air drawing opening such as the downstream side guide opening 31*a* to the multiple air drawing devices is not tapered, thereby enhancing the exhaust efficiency.

By arranging the multiple downstream side guide openings 31*a* and the multiple air passage openings 45, as illustrated in FIGS. 4 and 5, the air flow H4 of the air heated over the entire width direction of the sheet P can be drawn. By so doing, generation of the temperature gradient in the width direction of the sheet P in the sheet conveying path and the discharging port interior space 50 can be prevented.

The fixing unit 17 further includes a function to store heat in order to fix the image formed on the sheet P to the sheet P. However, the image forming apparatus 100 draws air from the space between the fixing unit 17 and the sheet discharging port 180 and exhausts the air in the space to the outside the image forming apparatus 100. Therefore, it is likely that the air that needs to remain at high temperature is cooled. If the temperature of the fixing unit 17 is cooled, heat that is needed for fixing is taken, and therefore, the power consumption of the entire image forming apparatus 100 increases.

By contrast, the image forming apparatus 100 according to the present embodiment further includes a shield wall 43, as illustrated in FIGS. 3 and 4. The shield wall 43 shields an upper space 51 of the fixing unit 17 and a discharging port interior space 50 of the sheet discharging port 180, so that heat of the fixing unit 17 is not removed.

As illustrated in FIGS. 3 and 4, the shield wall 43 is positioned near the outside of the upper face of the fixing unit 17, which is a downstream side end face of the fixing unit 17 in the sheet conveying direction. If the shield wall 43 is disposed inside the fixing unit 17, movement of the air flow H1 illustrated in FIG. 3 cannot be shielded. Further, if the shield wall 43 is disposed closer to the output sheet stacker 20, an air flow that is indicated by two-dot chain line with arrow F in FIG. 3 cannot obtain a sufficient distance in the sheet conveying path R1. Therefore, a sufficient cooling cannot be performed. Therefore, the shield wall 43 is disposed near the outside of the upper face of the fixing unit 17.

The sheet P that is discharged from the fixing unit 17 is guided to the sheet discharging port 180 including the pair of sheet discharging rollers 18 by the upstream upper guide plate 30, the downstream upper guide plate 31, and the lower guide plate 32. The upstream upper guide plate 30 includes an upstream side guide opening 30*a* and the downstream upper guide plate 31 includes a downstream side guide opening 31*a*. Then, as an air flow that is generated by driving the air suction fan 42 passes through the downstream side guide opening 31*a*, the sheet conveying path R1 is cooled.

Part of the air flow H1 of the air at high temperature that is heated by the fixing unit 17 passes below the shield wall 43 together with the sheet P to flow toward the downstream side of the sheet conveying path R1. The heated air heated by the heat of the sheet P and the heated air that passes below the shield wall 43 are sucked by the air suction fan 42 to pass through the downstream side guide opening 31*a* before being exhausted to the outside of the image forming apparatus 100. Accordingly, the heated vapor such as the heated air flowing in the sheet conveying path R1 toward the sheet discharging port together with a recording medium such as the sheet P can be drawn from the air passage opening and can be prevented from being discharged together with the recording medium through the sheet discharging port to the output sheet stacker. Consequently, an increase in the temperature of the output sheet stacker 20 can be prevented.

The shield wall 43 is disposed between the upstream upper guide plate 30 and the downstream upper guide plate 31 and is located upstream from the downstream side guide opening 31*a* in the sheet conveying path R1. The downstream side guide opening 31*a* is an opening through which the air is sucked by the air suction fan 42 in the sheet conveying path R1.

By so doing, the heated air heated by the fixing unit 17 is blocked by the shield wall 43, except the air that has passed below the shield wall 43, and stays in the upper space 51 of the fixing unit 17. Since the air at high temperature remains in the upper space 51 adjacent to the fixing unit 17, the air that needs to remain heated in the fixing unit 17 is prevented from being cooled, and therefore an increase in the power consumption of the entire image forming apparatus 100 can be prevented.

Further, by including the shield wall 43 in the image forming apparatus 100, the air that reaches the discharging port interior space 50 of the sheet discharging port 180 from the upstream side (the right side in FIG. 3) from the shield wall 43 is limited to the air that passes below the shield wall 43. At this time, an amount of flow of air that passes through the air passage opening 45 by suction of the air suction fan 42 is set to be smaller than an amount of flow that passes below the shield wall 43. Specifically, this setting of the amount of flow of air can be achieved by making an opening area of the sheet discharging port 180 greater than a cross sectional area of a gap below the shield wall 43 through which the air passes. Accordingly, the air can pass through the sheet discharging port 180 more easily than the gap below the shield wall 43. Therefore, generation of air flow that flows from the output sheet stacker 20 into the casing 19 via the sheet discharging port 180 can be promoted.

Accordingly, the image forming apparatus 100 can generate air that flows from the output sheet stacker 20 via the sheet discharging port 180 into the casing 19, then passes through the downstream side guide opening 31*a*, the air passage opening 45, and the air suction fan 42, and is exhausted through the air exhaust port 53 to the outside of the image forming apparatus 100.

The air in the output sheet stacker 20 is drawn from the sheet discharging port 180, so that air that flows in an opposite direction to the sheet conveying direction of the sheet P is generated in the area in the vicinity of the sheet discharging port 180 to be discharged. By so doing, the air at high temperature is prevented from being exhausted into the output sheet stacker 20 and the air in the image forming apparatus 100 can be cooled.

Further, by disposing the shield wall 43, the air that needs to remain heated in the image forming device 110 such as the fixing unit 17 is prevented from being cooled, and therefore an increase in the power consumption of the entire image forming apparatus 100 can be prevented. Further, by disposing the shield wall 43, an air flow path of air moving from the image forming device 110 toward an air drawing opening such as the downstream side guide opening 31*a* and the air passage opening 45 is tapered, thereby reducing the amount of air flow. Accordingly, generation of air flow that flows from an output sheet stacker such as the output sheet stacker 20 through a sheet discharging port to the interior of a housing such as the casing 19 toward the air passage opening can be promoted. Accordingly, the vapor such as the air toward an opposite direction to the sheet conveying path R1 of a recording medium such as the sheet P is generated. Therefore, the heated air is prevented from being exhausted together with the sheet P from the sheet discharging port to the output sheet stacker. Consequently, an increase in the temperature of the output sheet stacker 20 can be prevented.

Figure 6:
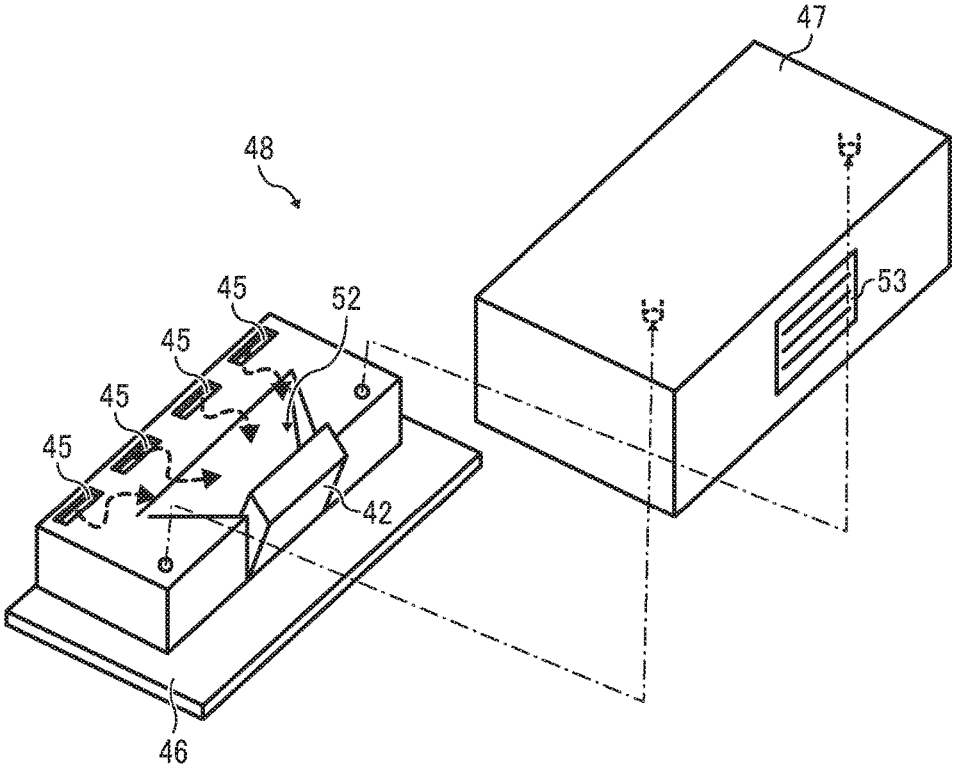
FIG. 6 is a diagram illustrating a configuration of a cooling unit in which a cooling mechanism including an air passage opening and an air suction fan is provided with an outer cover.

FIG. 6 is a diagram illustrating a configuration of a cooling unit 48 in which a cooling mechanism 46 including an air passage opening 45 and an air suction fan 42 is provided with an outer cover 47 to cover the wall 190 and the air suction fan 42. The cooling unit 48 functions as an air outlet device.

Air ducts and fans are included in a cooling unit to function typically as a cooling mechanism. Since attachment and detachment of the other units have higher priority to the cooling unit, the air ducts and fans are generally assembled as structural parts. In recent years, environmental loading reduction and good serviceability such as disassemblability and recyclability are demanded. Therefore, easy attachment and detachment is also desired to structural parts.

In the configuration illustrated in FIG. 6, the cooling mechanism 46 includes a recess 54 in the wall 190 that functions as a duct lower plate. The recess 54 of the wall 190 engages with a projection 55 mounted on the outer cover 47. The projection 55 functions as an engaging portion. As described above, the cooling mechanism 46 is attached to the outer cover 47 to construct the cooling unit 48. Therefore, the cooling mechanism 46 can be attached and detached with respect to the apparatus body 1 of the image forming apparatus 100 easily. The cooling unit 48 can be removed from the apparatus body 1 in a direction from the left to the right in FIG. 1, which is an opposite direction to the sheet conveying direction in the sheet conveying path R1. According to this configuration, the serviceability (e.g., disassemblability and recyclability) and assemblability of the image forming apparatus 100 are enhanced. It is to be noted that, the cooling unit 48 is disposed between the fixing unit 17 and the document reading device 2, as illustrated in FIG. 3.

Figure 7:
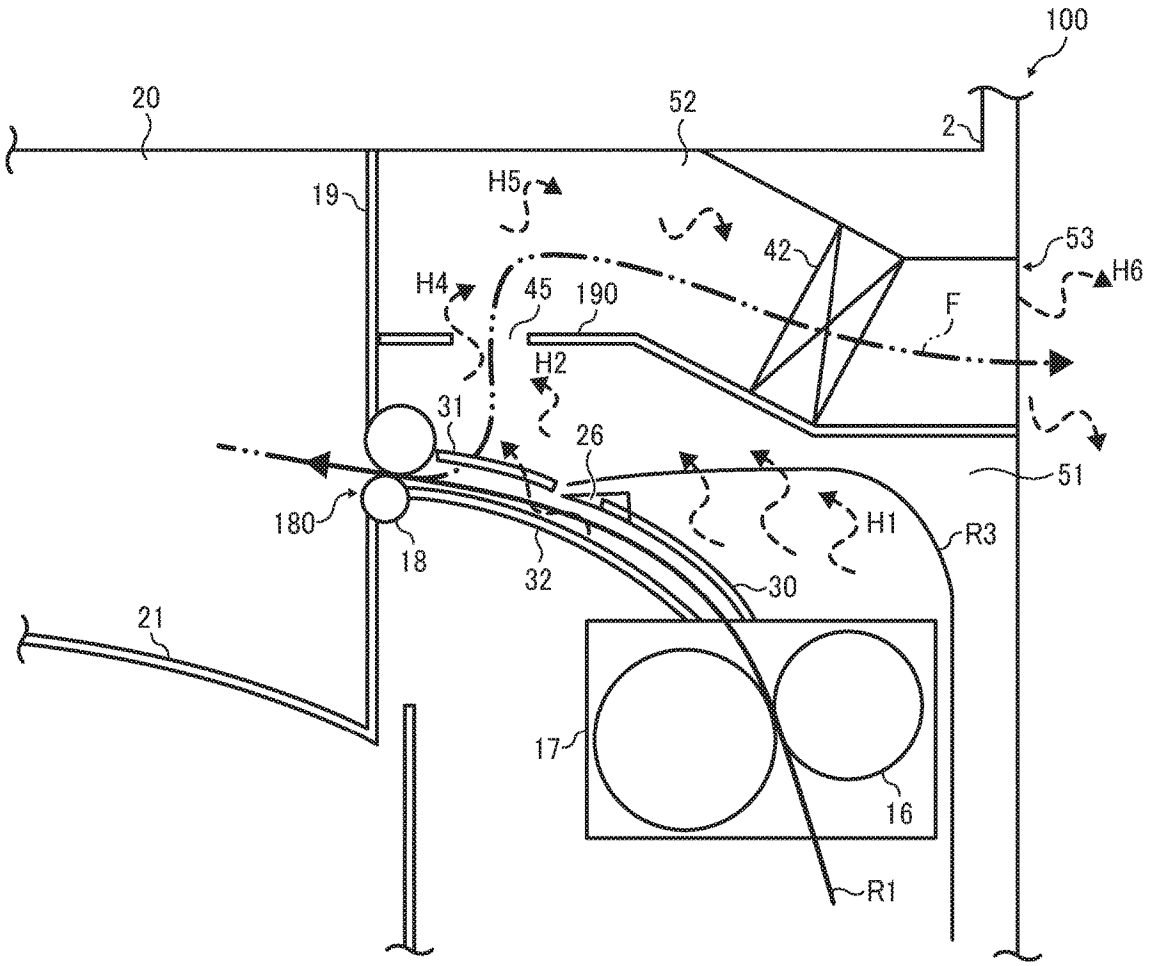
FIG. 7 is a schematic enlarged view illustrating an area near a fixing unit and a sheet discharging port of an image forming apparatus according to an embodiment of this disclosure.
Figure 8:
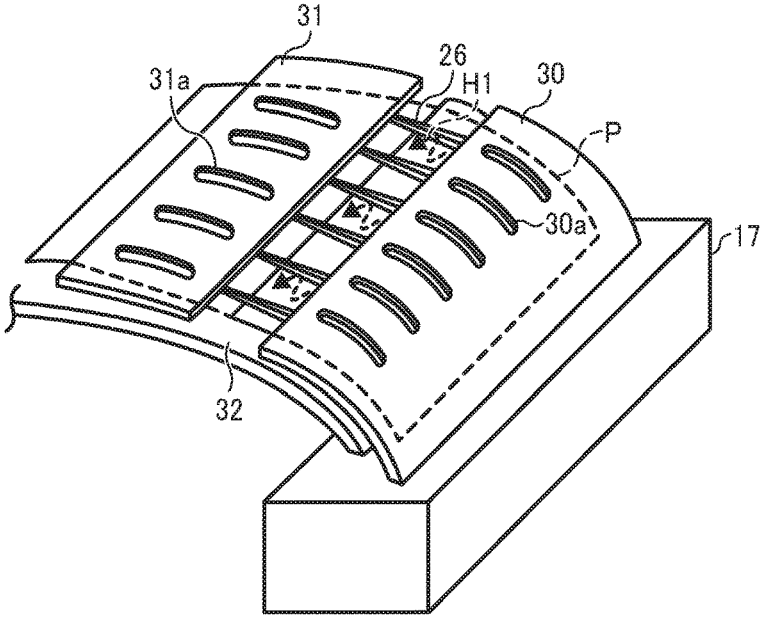
FIG. 8 is an enlarged perspective view illustrating the area near the sheet conveying path extending between the fixing unit and the sheet discharging port of FIG. 7.

FIG. 7 is a schematic enlarged view illustrating an area near the fixing unit 17 and the sheet discharging port 180. The configuration of FIG. 7 is a variation of the configuration of FIG. 3. FIG. 8 is an enlarged perspective view illustrating an area near the sheet conveying path of the sheet P between the fixing unit 17 and the sheet discharging port 180. The configuration of FIG. 8 is a variation of the configuration of FIG. 4.

As illustrated in FIG. 7, the reverse path switching claw 26 is disposed between the upstream upper guide plate 30 and the downstream upper guide plate 31.

As described above, when performing a single-side printing, the reverse path switching claw 26 is switched to a position illustrated in FIG. 7 to guide the sheet P that has passed through the fixing unit 17 to the sheet discharging port 180. By contrast, when performing a duplex printing, the reverse path switching claw 26 is switched to the position as illustrated in FIG. 7 and a first half on the leading edge side of the sheet P is exposed to the output sheet stacker 20 while the sheet P is being held between the pair of sheet discharging rollers 18. Thereafter, the leading edge of the reverse path switching claw 26 is rotated downwardly to guide the sheet P that has switched back from the pair of sheet discharging rollers 18 to the sheet reverse path R3 by the upper face of the downstream upper guide plate 31 and the upper face of the reverse path switching claw 26.

An upstream end in the sheet conveying direction of the reverse path switching claw 26 (the right side of FIG. 7) is disposed movable close to and far from the upstream side guide opening 30*a*, as illustrated in FIGS. 7 and 8. When the reverse path switching claw 26 enters the upstream side guide opening 30*a*, a gap is formed between an outer circumference of the reverse path switching claw 26 and an inner circumference of the upstream side guide opening 30*a*. The air flow of the heated air of the sheet P after the fixing operation moves upward from the gap. Consequently, the heated air that has passed through the upstream side guide opening 30*a*, the air flow H2 of the heated air that has passed through the downstream side guide opening 31*a*, and the air flow H1 of the heated air that moves upward from the fixing unit 17 pass through the air passage openings 45, then through the air suction fan 42. As a result, air flow to be discharged from the air exhaust port 53 to the outside of the image forming apparatus 100 is generated. It is to be noted that a direction in which the air flow is discharged outside the image forming apparatus 100 is opposite to a direction in which the sheet P is discharged from the sheet discharging port 180.

Figure 9:
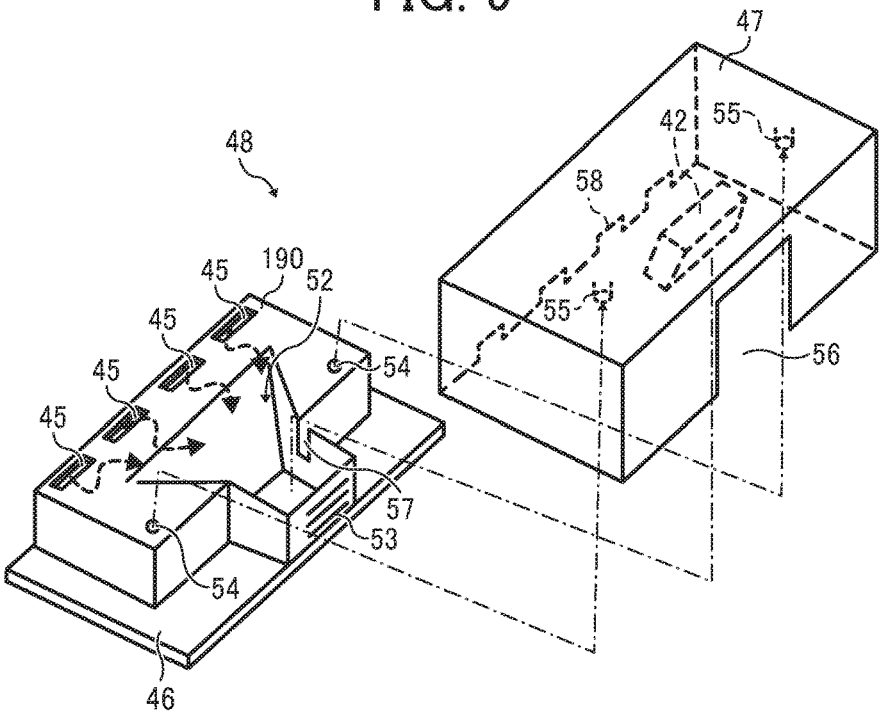
FIG. 9 is a diagram illustrating a configuration of a cooling unit in which a cooling mechanism including an air passage opening and an air suction fan is provided with an outer cover.

FIG. 9 is a diagram illustrating a configuration of a cooling unit in which a cooling mechanism including an air passing opening and an air suction fan is provided with an outer cover. The configuration of FIG. 9 is a variation of the configuration of FIG. 5.

The outer cover 47 has four side faces and a bottom face that is open. One side face of the four side faces is an upper left side face in FIG. 9 and functions as the casing 19 (see FIG. 3) extending upward from the sheet discharging port 180. Further, a retreating portion 58 is disposed at the lower edge of the side face to prevent intervening of the pair of sheet discharging rollers 18. Multiple retreating portions 58 are aligned in the width direction that intersects with the sheet conveying direction.

The air suction fan 42 is attached to an inner surface of the cover 47. By attaching the outer cover 47 with the air suction fan 42 to the cooling mechanism 46, the air suction fan 42 is contained in a position indicated by a broken line in FIG. 9, which is inside the air exhaust duct 52.

The air exhaust duct 52 is disposed projecting from the wall 190 functioning as a duct lower plate. An air exhaust port 53 is provided at a leading end face of the air exhaust duct 52. The air exhaust port 53 is disposed at a position facing an opening 56 of the outer cover 47. When the outer cover 47 is attached to the cooling mechanism 46, the air exhaust port 53 is exposed from the opening 56. Further, the air exhaust duct 52 includes a slit 57 that engages with a lateral side face of the air suction fan 42. Accordingly, the air suction fan 42 is positioned relative to the air suction fan 42 reliably.

Figure 10:
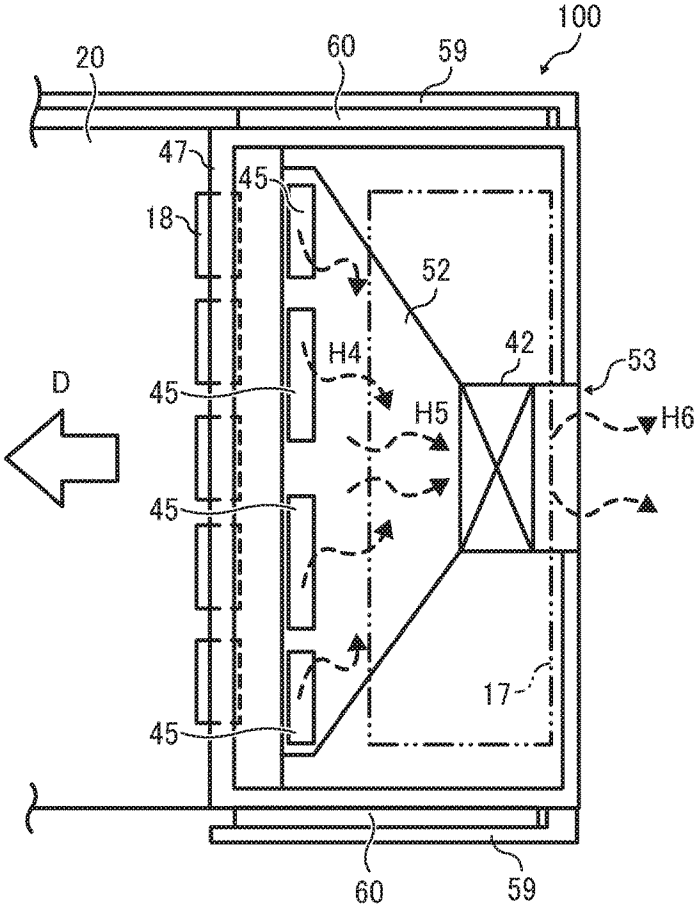
FIG. 10 is a schematic top view illustrating the air exhaust duct.

FIG. 10 is a schematic top view illustrating an exhaust duct.

A basic configuration of the cooling unit is identical to the configuration of the cooling unit illustrated in FIG. 9.

Different from the configuration illustrated in FIG. 9, the exhaust duct of FIG. 10 includes a guide 60 to engage with a guide rail 59 of the apparatus body. The guide 60 is provided on the side face of the outer cover 47. Accordingly, the cooling unit can be removed from a removing direction D that is identical to the sheet conveying path R1. Further, the left side face of the outer cover 47 functions as the casing 19 that extends upward from the sheet discharging port 180. Therefore, by releasing the cooling unit and the image forming apparatus from each other, the cooling unit can be pulled out easily.

Figure 11:
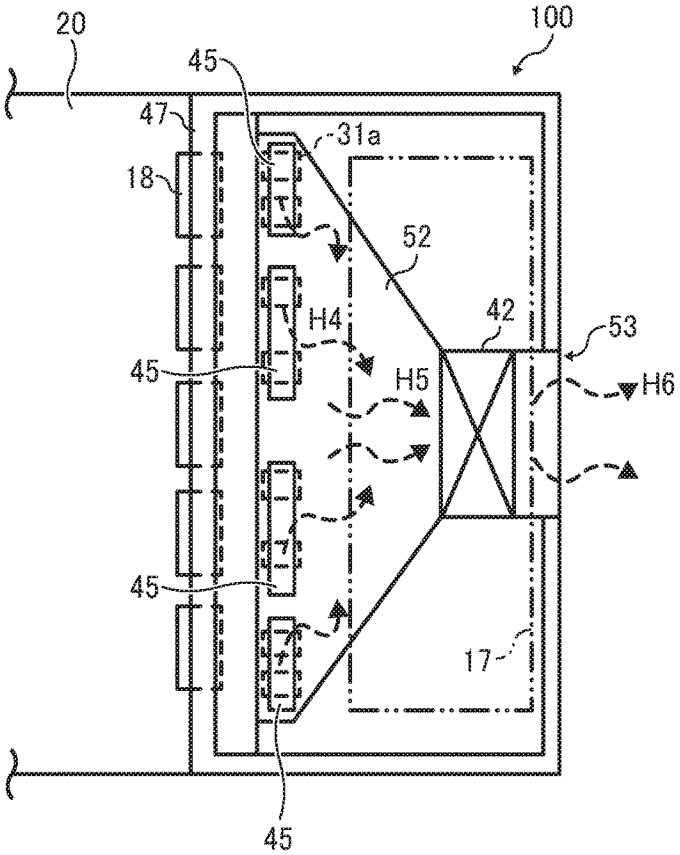
FIG. 11 is a schematic top view illustrating the air exhaust duct.

FIG. 11 is a schematic top view illustrating the exhaust duct.

The downstream side guide opening 31*a* is not limited to a slot shape that extends in the sheet conveying direction, as illustrated in FIG. 4. For example, the downstream side guide opening 31*a* may have a rectangular shape, as illustrated in FIG. 11. Further, the downstream side guide opening 31*a* is disposed immediately below the air passage opening 45, and multiple downstream side guide openings 31*a* are aligned within the width of the air passage opening 45. Further, the downstream side guide opening 31*a* is disposed to pass through the air passage opening 45 in the sheet conveying direction.

The sheet P that functions as a recording medium is not limited to indicate a regular paper material such as a plain paper but also includes thick paper, post card, envelope, thin paper, coated paper, art paper, tracing paper, and OHP (overhead projector) transparent film sheet.

It is to be noted that an image forming apparatus that can include the above-described features of the image forming apparatus 100 according to the present embodiment is not limited to include an image forming device and a document reading device disposed vertically with an in-body output sheet stacking section interposed therebetween. Specifically, this disclosure can be applied to any image forming apparatus that includes an output sheet stacker provided in an in-body space extending in a vertical direction so that a recording medium is discharged to the output sheet stacker and is removed by a user by inserting his/her hand through an opening on a side face of the apparatus body.

For example, this disclosure can be applied to an image forming apparatus such as a printer having the output sheet stacker in a space that is defined by an image forming device disposed at the upper part of the image forming apparatus and a sheet feeding device disposed at the lower part of the image forming apparatus and that is opening on at least one side wall of the apparatus body.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. An image forming apparatus comprising:

a sheet passage configured to guide a recording medium;

an image forming device configured to form an image on the recording medium;

a casing configured to accommodate the image forming device;

a sheet discharging port through which the recording medium having the image formed by the image forming device is discharged from the casing;

a discharging port interior space disposed inside the casing and including a part of the sheet passage and the sheet discharging port;

an air guide passage configured to guide air in the discharging port interior space to an outside of the casing; and an air exhauster disposed in the air guide passage and configured to exhaust the air to the outside of the casing, wherein the air guide passage is disposed extending from an air passage opening to an upstream side of a sheet conveying direction of the recording medium, and wherein the air exhauster is separated from the air passage opening in the sheet conveying direction of the recording medium.

2. The image forming apparatus according to claim 1, wherein the air guide passage tapers toward the air exhauster.

3. The image forming apparatus according to claim 1, further comprising a guide configured to contact an upper portion of the recording medium, wherein the guide includes guide openings disposed at equal intervals in a sheet width direction.

4. An image forming apparatus comprising:

a sheet passage configured to guide a recording medium;

an image forming device configured to form an image on the recording medium;

a casing configured to accommodate the image forming device;

a sheet discharging port through which the recording medium having the image formed by the image forming device is discharged from the casing;

a discharging port interior space disposed inside the casing and including a part of the sheet passage and the sheet discharging port;

an air guide passage that tapers toward the air exhauster and is configured to guide air in the discharging port interior space to an outside of the casing; and an air exhauster disposed in the air guide passage and configured to exhaust the air to the outside of the casing, wherein an air passage opening extends in a sheet width direction, and wherein the air exhauster is configured to exhaust air toward a side opposite to the sheet discharging port in the sheet conveying direction.

5. The image forming apparatus according to claim 4, further comprising a guide configured to contact an upper portion of the recording medium, wherein the guide includes guide openings disposed at equal intervals in a sheet width direction.

6. An image forming apparatus comprising:

a sheet passage configured to guide a recording medium;

an image forming device configured to form an image on the recording medium;

a casing configured to accommodate the image forming device;

a sheet discharging port through which the recording medium having the image formed by the image forming device is discharged from the casing;

a discharging port interior space disposed inside the casing and including a part of the sheet passage and the sheet discharging port;

an air guide passage that tapers toward the air exhauster and is configured to guide air in the discharging port interior space to an outside of the casing; and an air exhauster disposed in the air guide passage and configured to exhaust the air to the outside of the casing, wherein the air exhauster is disposed to cause the air to be exhausted toward an upstream side in a sheet conveying direction of the recording medium.

7. The image forming apparatus according to claim 6, further comprising a guide configured to contact an upper portion of the recording medium, wherein the guide includes guide openings disposed at equal intervals in a sheet width direction.

* * * * *